US006406512B2

(12) United States Patent
Voronenko et al.

(10) Patent No.: US 6,406,512 B2
(45) Date of Patent: Jun. 18, 2002

(54) METHOD FOR PRODUCING HIGH-PURITY NIOBIUM

(75) Inventors: Ljudmila Ivanovna Voronenko; Alexandr Vyacheslavovich Eljutin; Kirill Semenovich Kovalev; Felix Vladimirovich Kovalev, all of Moscow (RU)

(73) Assignee: Federalnoe Gosudarstvennoe Unitarnoe Predpriyatie Gousudarstvenny Nauchno-Issledovatelsky I Proektny Institut Redkometallicheskoi Promyshlennosti "Giredmet" , Moscow (RU)

( * ) Notice: Subject to any disclaimer, the term of this patent is extended or adjusted under 35 U.S.C. 154(b) by 0 days.

(21) Appl. No.: 09/824,740

(22) Filed: Apr. 4, 2001

(30) Foreign Application Priority Data

Apr. 6, 2000 (RU) ..... 2000108335

(51) Int. Cl.[7] ..... C22B 9/22; C22B 34/34
(52) U.S. Cl. ..... 75/10.63; 75/622
(58) Field of Search ..... 75/10.63, 622

(56) References Cited

FOREIGN PATENT DOCUMENTS

RU 2114928 7/1998

OTHER PUBLICATIONS

Smiakage, et al. "Refining of Crude Niobium by Molten Salt Electrolysis and Electron Beam Melting Process." First International Conference on Processing Materials for Properties. The Minerals Metals and Materials Society 1993. pp. 433–6.*

Kamat et al. "Open Aluminothermic Reduction of Columbium (Nb) Pentoxide and Purification of the Reduced Metal." Metallurgical Transactions, Nov. 1971, vol. 2, No. 10, pp. 2817–2823.*

"Niobum and Tantalum", Moscow *"Metallurgy"* 1990, pp. 156–161 No month.

* cited by examiner

*Primary Examiner*—Roy King
*Assistant Examiner*—Tima McGuthry-Banks
(74) *Attorney, Agent, or Firm*—Burns, Doane, Swecker & Mathis, L.L.P.

(57) ABSTRACT

A method for producing high-purity niobium involves refining crude niobium in an electrolyte comprising a melt of salts containing a complex niobium and potassium fluoride and an equimolar mixture of alkaline metal chlorides, the electrolyte further containing sodium fluoride in the amount of from 5 to 15 wt %, and subjecting the obtained cathode deposit to electron-beam melting in a vacuum free of oil vapors under a residual gas pressure of from $5*10^{-5}$ to $5*10^{-7}$ mm Hg, a melting rate of from 0.7 to 2 mm/min and a leakage into a melting chamber from 0.05 to 0.005 $l \cdot \mu m/s$ to produce an ingot of niobium. The method produces high-purity niobium having the total amount of impurities within the range of from 0.002 to 0.007 wt % which satisfies the requirements imposed on the materials used in microwave technology and microelectronics, with reduced losses of niobium in both of the refining stages and increased yield of high-purity niobium.

3 Claims, No Drawings

METHOD FOR PRODUCING HIGH-PURITY NIOBIUM

This application claims priority under 35 U.S.C. §§ 119 and/or 365 to 2000108335 filed in Russia on Apr. 6, 2000; the entire content of which is hereby incorporated by reference.

FIELD OF THE INVENTION

The present invention relates to metallurgy of refractory rare-earth metals, and more particularly, to niobium metallurgy, and is useful in the production of high-purity niobium and articles made thereof for microwave technology and microelectronics.

BACKGROUND OF THE INVENTION

Very stringent requirements are imposed on the purity of materials used in the aforementioned fields (total amount of impurities shall not exceed 0.01 wt % or 100 ppm by weight). Electrical and physical properties of instruments and apparatuses are defined by the purity grade of the metal and articles made thereof.

A conventional method for producing high-purity niobium includes refining alumocalciothermic niobium having a starting niobium content of from 93 to 96 wt %, the refining being conducted in an electron beam furnace by a drip melt method into a crucible with electromagnetic stirring of the melt, the consumable preform being charged into a melting zone to draw an ingot. The ingot obtained after the remelting is used as a consumable preform for subsequent remelting. Required number of remelts is dictated by the content of impurities in the starting metal and the desired refinement degree. At least one of the remelts, except the last one, is conducted by successive overlaying of portions of the metal, upon the overlaying each of the portions being held with simultaneous exposure to the electron beam and electromagnetic stirring, and the next portion is overlaid after achieving a desired degree of refining the metal. The holding is executed after removing the consumable preform from the melting zone and terminating the drawing of the ingot. The final product is Hbi grade niobium meeting GOST 16099-80 standard which dictates the following content of each of the impurities: nitrogen, oxygen, carbon and aluminum at a level of 0.01 wt %, the total amount of tungsten and molybdenum impurities of 0.01 wt %, and tantalum amount of up to 0.1% wt (see RU patent No.2114928, publ. 10.07.98, Int.C1. C 22 B 34/24).

Niobium produced by the above method, however, comprises a total of 0.15 to 0.2 wt % impurities, i.e. twenty times the required amount.

Another conventional method for producing high-purity niobium includes electrolytic refining of a starting niobium from fluoride/chloride melts, followed by electron-beam melting of the cathode metal. The refining process includes anode dissolution of crude niobium in a melt comprising potassium fluoroniobate and an equimolar mixture of potassium and sodium chlorides to produce cathode metal having a relatively low content of refractory metal impurities (tungsten, molybdenum, tantalum), nitrogen and carbon. The following electron-beam melting provides essential reduction in the content of oxygen, iron, silicon and impurities of alkaline and alkaline-earth metals (Zelikman A. N. et al. Niobium and Tantalum, M., Metallurgy, 1991, pages 156–161).

However, the above method results in a rather high content of carbon (up to 0.02 wt %) and nitrogen (up to 0.05% wt %) impurities which are relatively slow removed in the electron-beam melting process (i.e. their removal requires additional remelts which is dictated not only by the increased evaporation losses of the metal and the longer melting cycle, but also by the increased concentration of difficultly volatile components), and a high content of tungsten and molybdenum impurities (up to 0.001 wt % each) which not only stay unremoved in the melting process, but also accumulate in the ingot owing to evaporation of the basic metal (niobium), and the greater the number of remelts, the greater the accumulation.

OBJECT OF THE INVENTION

The object of the present invention is to provide a method for producing high-purity niobium having the total content of impurities in the range of from 0.002 to 0.007 wt % which would satisfy the requirements imposed on the materials used in microwave technology and microelectronics, with reduced niobium losses in both refining stages and increased yield of high-purity niobium.

SUMMARY OF THE INVENTION

In accordance with the invention, a method for producing high-purity niobium involves refining crude niobium in an electrolyte comprising a melt of salts including a complex niobium and potassium fluoride (potassium fluoroniobate) and an equimolar mixture of alkaline metal chlorides, said electrolyte further comprising sodium fluoride in the amount of from 5 to 15 wt %, and subjecting the obtained cathode deposit to electron-beam melting in a vacuum free of oil vapors at a residual gas pressure of from $5*10^{-5}$ to $5*10^{-7}$ mm Hg, a melting rate of from 0.7 to 2 mm/min and a leakage into a melting chamber of from 0.05 to 0.005 $l\cdot\mu m/s$ to produce an ingot of niobium.

In a preferred embodiment, the electrolytic refining is carried out in a melt comprising the components in the following amount: 10–20 wt % potassium fluoroniobate, 5–15 wt % sodium fluoride, the balance being an equimolar mixture of potassium and sodium chlorides. In another preferred embodiment, the ingot produced after the electron-beam melting is subjected to plastic working at a temperature in the range of from 300 to 800° C., and the obtained articles are subjected to thermal and chemical treatment.

The essence of the present invention is as follows. Sodium fluoride in the amount of from 5 to 15 wt % is added to an electrolyte comprising a complex niobium and potassium fluoride and an equimolar mixture of alkaline metal chlorides. This changes the discharge (dissolution) potential relationship of niobium and the majority of accompanying impurities (including N, C, W, Mo, Ta, Fe etc.) and provides a more fine purification of niobium.

Furthermore, the addition of sodium fluoride to the electrolyte promotes the formation of a protecting film of lower nickel fluorides on the internal surface of a working vessel, which reduces the internal surface wear and increases the life of the vessel.

The presence of sodium fluoride in the electrolyte in the range in accordance with the invention significantly reduces the electrolyte melting point, hence, the viscosity at the electrolytic refining temperature of 680–760° C. The reduction in the electrolyte viscosity improves adhesion between the deposit and the cathode (i.e. prevents shedding the deposit on the bottom of the vessel) and substantially prevents entrainment of the electrolyte by the formed cathode deposit. Niobium obtained after termination of the electrolytic refining process is in the form of a coarsedendrite cathode deposit, and the current efficiency for tetravalent niobium is raised to 90–98%. The anode metal output factor may be brought to 90% without sacrificing the quality of the produced metal.

The conditions of the electron-beam melting in accordance with the invention, in particular: melting the obtained cathode metal in a vacuum free of oil vapors at a residual gas pressure of from $5*10^{-5}$ to $5*10^{-7}$ mm Hg, a leakage into the melting chamber of from 0.05 to 0.005 $1\cdot\mu m/s$ and a melting rate of from 0.7 to 2 mm/min, provide maximum removal of the impurities: oxygen (up to 0.0002 wt %), alkaline and alkaline-earth metals (up to 0.00001 wt %), iron and silicon (up to 0.00001 wt % each), and, at the same time, prevent the increase in the content of nitrogen and carbon impurities above their equilibrium values in niobium (0.0004 wt %) at a minimum number of remelts and minimum niobium losses associated with them.

Stringent requirements are imposed not only on the purity, but also on the metal structure of niobium articles used in microwave technology and microelectronics. These requirements are met owing to the claimed conditions of plastic working at a temperature from 300 to 800° C. and subsequent thermal and chemical treatment of articles. The plastic working conditions in accordance with the invention provide the production of worked articles free of the microporosity inherent in the ingots, and exclude pollution of niobium by interstitial impurities (i.e. maintain the starting cast metal purity in the articles). This provides for the attainment of the desired service performance of the articles.

DETAILED DESCRIPTION OF THE INVENTION

Addition of less than 5 wt % of sodium fluoride to the electrolyte comprising a complex niobium and potassium fluoride and an equimolar mixture of alkaline metal chlorides increases the viscosity of the electrolyte melt in the electrolytic refining process, raises the content of impurities of refractory metals, iron, nitrogen and carbon in the cathode metal, reduces the current efficiency for tetravalent niobium to 85%, and increases niobium losses in the subsequent electron-beam melting due to splashing caused by the increased content of electrolyte inclusions.

The increase in the sodium fluoride content in the electrolyte above 15% is unadvisable because this leads to the increased melting point of the electrolyte and disappearance of the effect of melt viscosity reduction at the electrolytic refining, and raises iron content in the cathode metal.

When the electron-beam melting of the obtained electrolytic niobium is conducted in a vacuum created by oil-vapor pumps, the carbon impurity content in the metal increases up to 0.005 wt % due to the increased content of hydrocarbons in the residual gas environment in the melting chamber.

The electron-beam melting under a residual gas pressure in the melting chamber above $5*10^{-5}$ mm Hg leads to the enrichment of niobium by interstitial impurities, while the residual gas pressure in the melting chamber at a level of $5*10^{-7}$ mm Hg provides the attainment of equilibrium concentrations of interstitial impurities in niobium; the melting at a lower residual gas pressure is unreasonable because this results in a longer melting cycle, increases the cost of electron-beam installations and makes their servicing more complicated.

With a leakage into the melting chamber above 0.05 $1\cdot\mu m/s$, niobium is enriched by interstitial impurities.

Reduction of the leakage value below 0.005 $1\cdot\mu m/s$ is unadvisable as this results in the increased cost of the electron beam installations and makes their servicing more complicated.

Melting conducted at a rate below 0.7 mm/min results in the enrichment of niobium by impurities of refractory metals (tungsten, molybdenum, tantalum) due to evaporation of the basic metal, and additional evaporation losses of niobium.

Melting at a rate above 2 mm/min prevents the achievement of equilibrium concentrations of interstitial impurities and volatile impurities in niobium, i.e. leads to incomplete refining of niobium from these impurities.

Plastic working of the obtained high-purity niobium ingots at a temperature below 300° C. fails to eliminate structural deficiencies (microporosity) in the ingots, which could result in high-voltage breakdown if the ingot is used to manufacture microwave cavities, or in splashing the metal and deterioration of the film quality if niobium is used as a magnetron sputtering target.

With plastic working of high-purity niobium at a temperature above 800° C., the metal is polluted by interstitial impurities.

The advantages of the invention described above will become more readily apparent from the following detailed description of its embodiment.

Crude niobium in the amount of 3 kg and constituent salts of the electrolyte in the following amounts: 900 g of potassium fluoroniobate, 600 g of sodium fluoride, 4500 g of the equimolar mixture of potassium and sodium chlorides, were charged into a nickel vessel with a capacity of 4 l. The ratio of the electrolyte components was: potassium fluoroniobate 15%, sodium fluoride 10%, the equimolar mixture of potassium and sodium chlorides 75%.

The vessel was put into a sealed electrolytic cell, which was evacuated to provide the residual gas pressure of 0.01 mm Hg, and filled with pure argon. The salts were heated to melting, the operating temperature (760° C.) was set and maintained for one hour. A cathode in the form of a cylinder nickel rod of 12 mm in diameter was immersed into the melt, and direct current was applied. Upon 12 hours of the electrolysis, the cathode with cathode deposit was taken out from the bath into the cathode chamber. Being cooled to 40–50° C., the cathode with the deposit was taken out from the chamber and treated by 5% hydrochloric acid solution to remove the entrapped electrolyte from the deposit. Niobium dendrites were washed by distilled water and dried. Parameters of the electrolytic process and the composition of the obtained metal are presented in Tables 1 and 2.

TABLE 1

Parameters of the electrolytic process and characteristics of crude and refined niobium

| Electrolysis parameters | Characteristics of parameters | Characteristics of niobium: Impurity element | Impurity content, wt % crude metal | Impurity content, wt % refined metal |
|---|---|---|---|---|
| Electrolyte composition: | | | | |
| $K_2NbF_7$ | 10–20% | Ta | 0.009 | <0.0001 |
| NaF | 5–15% | W | 0.01 | <0.00001 |
| (KCl—NaCl) | balance | Mo | 0.01 | <0.00001 |
| Electrolyte temperature | 680–760° | Al | 8.7 | <0.001 |
| Cathode | 0.1–0.8 | Zr | 0.005 | <0.00002 |
| current density | $A/cm^2$ | Si | — | <0.001 |
| Anode current | 0.02–0,05 | Cr | 0.0002 | <0.00002 |
| density | $A/cm^2$ | Fe | 0.02 | 0.004–0.015 |
| Duration of | 12–20 hours | C | 0.02 | <0.0001 |

TABLE 1-continued

| Parameters of the electrolytic process and characteristics of crude and refined niobium | | | | |
|---|---|---|---|---|
| | Characteristics of parameters | Characteristics of niobium | | |
| Electrolysis parameters | | Impurity element | Impurity content, wt % crude metal | Impurity content, wt % refined metal |
| day cycle of electrolysis | | | | |
| Anode metal output ratio | 90% | N | 0.046 | <0.0001 |
| Current efficiency for tetravalent niobium | 90–98% | O | 0.12 | 0.004–0.015 |

TABLE 2

| Parameters of the electrolytic refining process and impurity composition of the refined metal in relation to sodium fluoride content in the electrolyte | | | |
|---|---|---|---|
| Parameters of electrolysis | Characteristics of parameters in relation to sodium fluoride content in electrolyte Sodium fluoride content, wt % 0–4 | 5–15 | 16 |
| Electrolyte melting point | 640–650° C. | 600–610° C. | 655–660° C. |
| Anode metal output ratio | 85% | 90% | 90% |
| Current efficiency for tetravalent niobium | 85–90% | 95–98% | 95–98% |
| Impurities content, wt % | | | |
| nitrogen | 0.001 | <0.0001 | 0.0001 |
| carbon | 0.002 | <0.0001 | 0.0001 |
| iron | 0.02 | 0.004–0.015 | 0.03–0.04 |
| tungsten | 0.001 | <0.00001 | 0.0001 |
| molybdenum | 0.001 | <0.00005 | 0.0001 |

As follows from Tables 1 and 2, addition of niobium fluoride to the electrolyte at the claimed ratio of components reduces the content of impurities of nitrogen, carbon, tungsten and molybdenum to the values below 0.0001 wt % each, iron to 0.004–0.015 wt %, and raises the niobium current efficiency up to 95–98% with the anode metal output of up to 90%.

The electron beam refining of the electrolytic niobium was conducted in a 100 kW installation equipped with a titanium sublimation pump to create vacuum free of oil vapors in a melting chamber.

Niobium dendrites produced by the electrolytic refining were compacted to produce small bars of 30×30×600 mm in size and charged into a starting material supply section located in the melting chamber of the installation. A total of 12 kg was charged simultaneously. The melting chamber and an electron gun chamber were evacuated to a residual gas pressure in the range of from $5*10^{-6}$ to $5*10^{-7}$ mm Hg. Once the operating vacuum has been created, the installation melting chamber was cut off from pumps, and the leakage value was monitored. Then, the pumps were open, the electron gun was actuated, and niobium bars were subjected to drip melting into a copper water-cooled upright crucible of 80 mm in diameter. Upon termination of melting and cooling the ingot, the melting chamber was opened and the obtained ingot was fixed in the starting material supply section for re-melting. If a more complete refining of niobium from oxygen, iron and silicon impurities is required, the ingot may be remelt for the third time. The first remelt (of bars) was conducted at the electron beam power of from 35 to 40 kVA, the second and third remelts (of the ingot) were conducted at a power of from 40 to 45 kVA. The melting conditions and characteristics of the resulting metal are summarized in Tables 3 and 4.

TABLE 3

| Characteristics of niobium melted under different conditions of electron-beam refining in oil-free vacuum | | | | | |
|---|---|---|---|---|---|
| | Impurity content in different melting conditions, ppm wt. Residual gas pressure in melting chamber, mm Hg. | | | | |
| | $(1–5)*10^{-6}$ Leakage, 1 · μm/s | | | | $(7–8)*10^{-5}$ Leakage, 1 · μm/s |
| Impurity | 0.01 Melting rate (U), mm/min | | | 0.1 U, mm/min | 0.1 U, mm/min |
| element | 0.5 | 1.5 | 2.5 | 1.5 | 1.5 |
| O | 1–3 | 2–5 | 10–15 | 10–15 | 20–30 |
| N | 2–4 | 2–4 | 2–5 | 7–10 | 20–30 |
| C | 1–4 | 1–4 | 1–5 | 5–7 | 10–20 |
| Fe | <0.05 | 0.05 | 1–1.5 | 0.05 | 0.05 |
| Si | <0.05 | <0.1 | 0.5–1 | <0.1 | 0.1 |
| W | 20–30 | 2–10 | 1–5 | 2–10 | 2–10 |
| Mo | 10–20 | 1–10 | 1–5 | 1–10 | 1–10 |
| Ta | 15–50 | 5–30 | 3–15 | 5–30 | 5–30 |
| Niobium loss in melting, wt % | 35 | 25 | 20 | 25 | 25 |

TABLE 4

| Characteristics of niobium ingots melted from electrolytic metal in electrolytic and electron-bean refining conditions in accordance with the invention | | |
|---|---|---|
| Impurity element | Impurity content in niobium ingot ppm wt | % wt |
| O | 2–5 | $(2–5)*10^{-4}$ |
| N | 2–4 | $(2–4)*10^{-4}$ |
| C | 1–4 | $(1–5)*10^{-4}$ |
| W | 2–10 | $(2–10)*10^{-4}$ |
| Mo | 1–10 | $(1–10)*10^{-4}$ |
| Ta | 5–30 | $(5–30)*10^{-4}$ |
| Fe | 0.01–0.05 | $(1–5)*10^{-6}$ |
| Ni (Co) | <0.02 | $<2*10^{-6}$ |
| Si | 0.01–0.1 | $(1–10)*10^{-6}$ |
| Na, K, Ca, Mg, Mn, Al, V, Cr, Cu, Zn, platinum metals | <0.02 | $<2*10^{-6}$ |
| F | <0.5 | $<5*10^{-5}$ |
| B, Cl, Br, S | <0.02 | $<2*10^{-6}$ |
| Ti | <0.2 | $<2*10^{-5}$ |
| Hf, Zr | <0.1 | $<1*10^{-5}$ |
| Ga, Ge, As, Se, Sn, Sb, Te | <0.05 | $<5*10^{-6}$ |
| Re | <0.1 | $<1*10^{-5}$ |
| Bi, Pb, Ti, Hg | <0.06 | $<6*10^{-6}$ |
| Hardness, HB kg/mm$^2$ | 34–42 | |

Data in Tables 3 and 4 demonstrate that the conditions of the electron-beam refining in accordance with the invention provide the following results:

niobium is finely purified from oxygen and impurities of alkaline and alkaline-earth metals, iron and silicon;

the produced niobium has a low content of nitrogen and carbon impurities;

a total content of refractory metal impurities in the produced niobium is at a level of 20 to 50 ppm by weight (0.002 to 0.005 wt %)

A high-purity niobium ingot of 80 mm in diameter was forged at 800° C. to a sheet billet 25 mm thick, and upon stripping a 1 mm thick layer by milling the sheet billet was cold rolled to a strip 1 mm in thickness. The strip was etched to remove a 10 μm thick layer and annealed at 600° C. Quality characteristics of the starting ingot and the rolled product upon annealing are shown in Table 5.

A high-purity niobium ingot of 80 mm in diameter was pressed at 600° C. to a rod of 45 mm in diameter, then pressed at 400° C. to a rod of 16 mm in diameter. The rod was etched (to remove a layer of about 20 μm) and forged at a swaging machine to a rod of 8 mm in diameter. The rods were etched (to remove a layer of about 10 μm) and annealed at 850° C. Table 5 shows characteristics of the starting ingot and the rods after annealing.

TABLE 5

Quality characteristics of the starting ingot and worked semi-products produced therefrom

| Metal | Impurity content (wt %) | | | Porosity | |
|---|---|---|---|---|---|
| | | | | Average pore diameter, | Number of pores per 1 |
| (niobium) | O | C | N | μm | $cm^2$ of surface |
| Original ingot | 0.0005 | 0.0002 | 0.0003 | 20–30 | 1.4–1.6 |
| Rolled product | 0.0006 | 0.0003 | 0.0003 | — | not found |
| Bar | 0.0005 | 0.0002 | 0.0003 | — | not found |

It is evident from Table 5 that the conditions of high-purity niobium plastic working in accordance with the invention make it possible to produce articles free of pores, maintain the starting cast metal purity and employ commercial heat treatment installations.

What is claimed is:

1. A method for producing high-purity niobium by refining crude niobium in an electrolyte consisting of a melt of salts including a complex niobium and potassium fluoride and an equimolar mixture of alkali metal chlorides, said electrolyte further containing sodium fluoride in the amount of from 5 to 15% by weight to obtain a cathode deposit, and subjecting the obtained cathode deposit to electron-beam melting in a vacuum free of oil vapors at a residual gas pressure in the range of from $5*10^{-5}$ to $5*10^{-7}$ mm Hg, a melting rate from 0.7 to 2 mm/min and a leakage into the melting chamber from 0.05 to 0.005 l·μm/s to produce an ingot of niobium.

2. The method according to claim 1, wherein said electrolytic refining of crude niobium is conducted in a melt of salts having the following ratio of components, expressed in percentage by weight:

| | |
|---|---|
| complex niobium and potassium fluoride | 10 to 20 |
| sodium fluoride | 5 to 15 |
| equimolar mixture of chlorides | the balance. |

3. The method according to claim 1, wherein said obtained ingot of high-purity niobium is subjected to plastic working at a temperature in the range of from 300 to 800° C., and the resulting articles are subjected to thermal and chemical treatment.

* * * * *